US005542997A

United States Patent [19]

Zeuner et al.

[11] Patent Number: 5,542,997

[45] Date of Patent: Aug. 6, 1996

[54] GAS-GENERATING MIXTURE

[75] Inventors: Siegfried Zeuner, München; Joachim Sans, Putzbrunn; Uwe Dölling, Holzkirchen; Karl-Heinz Rödig, Aschau/Inn, all of Germany

[73] Assignee: Temic Bayern-Chemie Airbag GmbH, Aschau, Germany

[21] Appl. No.: 246,551

[22] Filed: May 19, 1994

Related U.S. Application Data

[63] Continuation of Ser. No. 959,158, Oct. 9, 1992, abandoned.

[30] Foreign Application Priority Data

Oct. 11, 1991 [DE] Germany ..... 41 33 655.0
Jun. 5, 1992 [DE] Germany ..... 42 18 531.9

[51] Int. Cl.[6] ..... C06B 35/00
[52] U.S. Cl. ..... 149/35
[58] Field of Search ..... 149/35

[56] References Cited

U.S. PATENT DOCUMENTS

| | | | |
|---|---|---|---|
| 4,062,708 | 12/1977 | Goetz | 149/35 |
| 4,243,443 | 1/1981 | Utracki | 149/35 |
| 4,376,002 | 3/1983 | Utracki | 149/35 |
| 4,696,705 | 9/1987 | Hamilton | 149/35 |
| 4,836,255 | 6/1989 | Schneiter et al. | 149/35 |
| 4,931,111 | 6/1990 | Poole et al. | 149/35 |
| 4,981,536 | 1/1991 | Bender | 149/35 |
| 5,051,143 | 9/1991 | Goetz | 149/35 |
| 5,089,069 | 2/1992 | Ramaswamy | 149/35 |
| 5,143,567 | 9/1992 | Taylor et al. | 149/35 |
| 5,387,296 | 2/1995 | Taylor et al. | 149/35 |

*Primary Examiner*—Edward A. Miller
*Attorney, Agent, or Firm*—McGlew and Tuttle. P.C.

[57] ABSTRACT

A gas-generating mixture for an air bag, which has a rate of burnoff exceeding 40 mm/sec and good ignitability, but leads to a relatively low combustion temperature. The mixture is formed of an alkali or alkaline earth azide as the principal component, a metal oxide as the oxidizing agent and slag-forming agent, and 5 to 23 wt. % of an accelerator consisting of a metal nitrate and silicon dioxide, wherein the ratio of the metal nitrate to the silicon dioxide ranges from 4:1 to 1:4, and the silicon dioxide content is at least 4 wt. % of the mixture.

6 Claims, 1 Drawing Sheet

GAS-GENERATING MIXTURE

This is a file wrapper continuation of application Ser. No. 07/959,158 filed Oct. 9, 1992, now abandoned.

FIELD OF THE INVENTION

The present invention pertains to a gas-generating mixture, especially for inflating air bags for protecting passengers in motor vehicles, the gas generating mixture being formed of an alkali or alkaline earth azide, a metal oxide, and an accelerator for increasing the rate of burn-off formed of a metal and silicon dioxide.

BACKGROUND OF THE INVENTION

A gas-generating mixture for air bags consisting of sodium azide as the gas-supplying principal component, potassium nitrate as the oxidizing agent, and silicon dioxide has been known from DS-PS 22,36,175. The silicon dioxide has the task of binding the sodium and potassium formed as a slag during the reaction of the azide with the nitrate, i.e., to prevent these metals or their oxides from entering the propellant gas in the form of fine dust particles. Even though a rate of burnoff exceeding 40 mm/sec can be reached with the prior-art mixture, so that an air bag will be inflated within less than 100 microsec, it also has a satisfactory ignitability. However, a very high combustion temperature develops in the prior-art mixture, as a result of which the gas generator is subject to a high thermal load. In addition, the slag becomes highly fluid, so that it is difficult to retain it by a filter. In addition, gas-generating masses which consist of an alkali metal azide and a metal oxide, mostly iron oxide, have been known (of. U.S. Pat. No. 3,895,098). The metal oxide now serves both as an oxidizing agent and as a slag-forming agent. Even though the combustion temperature can be reduced with these prior-art masses, they have a low rate of burnoff and poor ignitability.

It is therefore suggested according to U.S. Pat. No. 4,376,002 that iron oxide be used together with silicon dioxide as the slag-forming agent. However, a rate of burnoff of only up to 33 mm/sec can be reached even with this. In addition, the ignitability is poor.

To increase the rate of burnoff, a gas-generating mass consisting of sodium azide, iron oxide, and graphite, which contains a mixture of potassium nitrate and clay (bentonite) as the accelerator, is suggested according to U.S. Pat. No. 4,931,111. However, a rate of burnoff of only up to ca. 30 mm/sec can be reached with this. As is shown by the Reference Example below in connection with FIG. 2, the ignitability of the mixture according to U.S. Pat. No. 4,931,111 is also very poor.

According to Example 5 of U.S. Pat. No. 4,931,111, a mixture of 62.0% sodium azide, 0.5% graphite, 4.36% potassium nitrate, 13.14% iron oxide, and 20% bentonite leads to a rate of burnoff of 29 mm/sec. If the bentonite is replaced with silicon dioxide in this mass according to Example 9 of U.S. Pat. No. 4,931,111, the rate of burnoff decreases drastically to 8.1 mm/sec.

SUMMARY AND OBJECTS OF THE INVENTION

The primary object of the present invention is to provide a gas-generating mixture which leads to a minimal output of very fine dust particles at a relatively low combustion temperature and has a sufficient rate of burnoff, as well as good ignitability.

According to the invention, a gas generating mixture of inflating airbags for protecting passengers in motor vehicles is provided comprising 55–70 wt. % of an alkali or alkaline earth azide, 10–35 wt. % of a metal oxide and an accelerator for increasing the rate of burn-off formed of a metal nitrate and silicon dioxide. The amount of accelerator is 5–23 wt. % of the mixture. The ratio of metal nitrate to silicon dioxide ranges from 4:1 to 1:4, and the silicon dioxide content of the mixture is at least 3 wt. % and preferably 4 wt. % is used.

Preferably, 50 wt. % of the particles of the mixture have a size of less then 10 microns. The metal oxide is preferably iron oxide with a particle size of less than 3 microns. The silicon dioxide is preferably pyrogenic silicic acid with a specific surface of at least 50 $m^2/g$. The metal nitrate is preferably potassium nitrate.

It was surprisingly found that, in complete contrast to Example 9 according to U.S. Pat. No. 4,931,111, the rate of burn-up is more than 40 mm/sec and satisfactory ignitability is obtained if no graphite is added, and the percentage of the silica in the mixture is at most 18 wt. %, i.e., the percentage of the accelerator consisting of metal nitrate and silica accounts at most for 23 wt. % of the mixture, wherein the silica amounts at most to four times the metal nitrate, i.e., the percentage of silica in the mixture according to the present invention is on the whole markedly lower than according to Example 9 of U.S. Pat. No. 4,931,111. However, to have sufficient rate of burn-up and ignitability, the percentage of silica in the mixture must be at least 3 wt. %. More than 4 wt. % are preferably used.

The rate of burn-up of more than 40 mm/sec that can be achieved with the mixture according to the present invention is consequently 25% higher than the maximum achievable rate of burn-up that can be obtained according to U.S. Pat. No. 4,931,111 by using bentonite, and nearly five times the rate of burn-up of the mixture according to Example 9 of U.S. Pat. No. 4,931,111, which contains 20% silica, 4.36% potassium nitrate, and 0.50% graphite. However, as is illustrated by the following example in connection with the diagram in FIG. 1, the mixture according to the present invention shows, above all, excellent ignitability.

The mixture according to the present invention also preferably contains one or more substances for improving the processability and/or the chemical stability. This may be a substance which improves both the processability and the chemical stability, but it is also possible to use two or more substances together, in which case one substance improves, e.g., the processability, while the other substance or other substances improve(s) the chemical stability. However, the content of all these substances combined is preferably at most 5 wt. %, relative to the total weight of the mixture, and especially preferably 0.1 to 3 wt. %.

These substances include flowability-improving and pressing aids, which possess properties ranging from neutral to basic, and/or hydrophobic properties, because this increases the chemical stability of the pressed bodies to the common components of air ($CO_2$, $H_2O$). These substances include, in particular, graphite, tricalcium phosphate, alkylene naphthalenesulfonic acid salts, talc, metal stearates, silicates, metal soaps, waxes, and silicones. Many of these substances also act as antistatics and thereby reduce the risk of electrostatic self-ignition of the mixture.

The amount of the alkali and/or alkaline earth azide in the mixture according to the present invention is preferably 58–65 wt. %. Sodium azide is preferably used as the alkali azide.

The content of metal oxides in the mixture according to the present invention is 15 to 35 wt. % and preferably 20 to 30 wt. %. Due to the metal oxide acting as an oxidizing agent and slag-forming agent, the mixture according to the present invention leads to a relatively low combustion temperature. The amount of pollutants discharged is at the same time minimal. Not only the percentage of slag particles in the propellant, i.e., the percentage of relatively coarse particles which are formed by the atomization of melted components, is low, but so is also especially the percentage of very fine dust particles consisting of alkali or alkaline-earth metals and oxide, which are particularly harmful, because they lead to corrosion of the mucosa and respiratory tract.

The percentage of the accelerator in the mixture is preferably 5 to 19 wt. %, and if the mixture contains at least one substance for improving the processability and/or the chemical stability, the percentage of accelerator is preferably 8 to 12 wt. %.

The ratio of metal nitrate to silica in the mixture according to the present invention is preferably in the range of 1:1 to 1:3, and if at least one substance for improving the processability and/or the chemical stability is present, it is in the range of 1:1 to 1:2.

The mixture according to the present invention is formed by mixing the powdered components, i.e., the alkali or alkaline earth azide, metal oxide, metal nitrate, and silicon dioxide. The particle size of the particles of the total mixture is preferably adjusted such that 50 wt. % of the particles of the total mixture will have a size of less than 10 microns. If the percentage of particles with a particle size of 10 microns or less does not reach 50 wt. %, the mixture is ground until this value becomes established. The mixture is subsequently pressed, e.g., into pellets.

Pyrogenic silicic acid (also known as fumed silica) with a specific surface of at least 50 $m^2/g$ (according to the BET method) and preferably with a specific surface larger than 200 $m^2/g$ is preferably used as the silicon dioxide. The silicon dioxide also acts as a pressing aid during the preparation of the pellets.

Oxides of the metals of the fourth Period of the transition elements, i.e., those with the atomic numbers ranging from 21 (scandium) to 30 (zinc), are used as metal oxides. The iron oxide is preferably used with a mean particle size of less than 3 microns and especially less than 1 micron. The iron oxide has a specific surface (according to the BET method) greater than 5 $m^2/g$ and preferably greater than 8 $m^2/g$. The metal nitrate may be an alkali and/or alkaline-earth nitrate, e.g., strontium nitrate or barium nitrate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

According to the invention, a gas generating mixture is provided formed of 55–70 wt. % of an alkali or alkaline earth azide, 10–35 wt. % of a metal oxide and an accelerator for increasing the rate of burn-off. The accelerator is formed of a metal nitrate and silica (silicon dioxide). The amount of the accelerator is 5–23 wt. % of the mixture. Ratio of the metal nitrate to silicon dioxide ranges from 4:1 to 1:4 and the silicon dioxide content of the mixture is at least 4 wt. %.

The present invention will be further explained by the following example.

EXAMPLE 1

The following powdered substances are mixed:

60.3% (14 moles) $NAN_3$, 11.9% (3 moles) $SiO_2$, 21.1% (2 moles) $Fe_2O_3$, and 6.7% (1 mole) $KNO_3$.

Pyrogenic silicic acid (Aerosil 380 from Degussa) with a specific BET surface of ca. 380 $m^2/g$ is used as the $SiO_2$. The $Fe_2O_3$ has a mean particle size of ca. 0.4 micron and a specific surface of 10.4 $m^2/g$, and is commercially available under the name "Mapico Red 297."

The mixture is ground until 50 wt. % of the particles have a particle size of less than 7 microns. Part of the mixture is subsequently pressed into pellets.

The pellets have the same good ignitability as pellets according to DE-PS 22,36,175. The rate of burnoff is 44 mm/sec.

Figure 1:
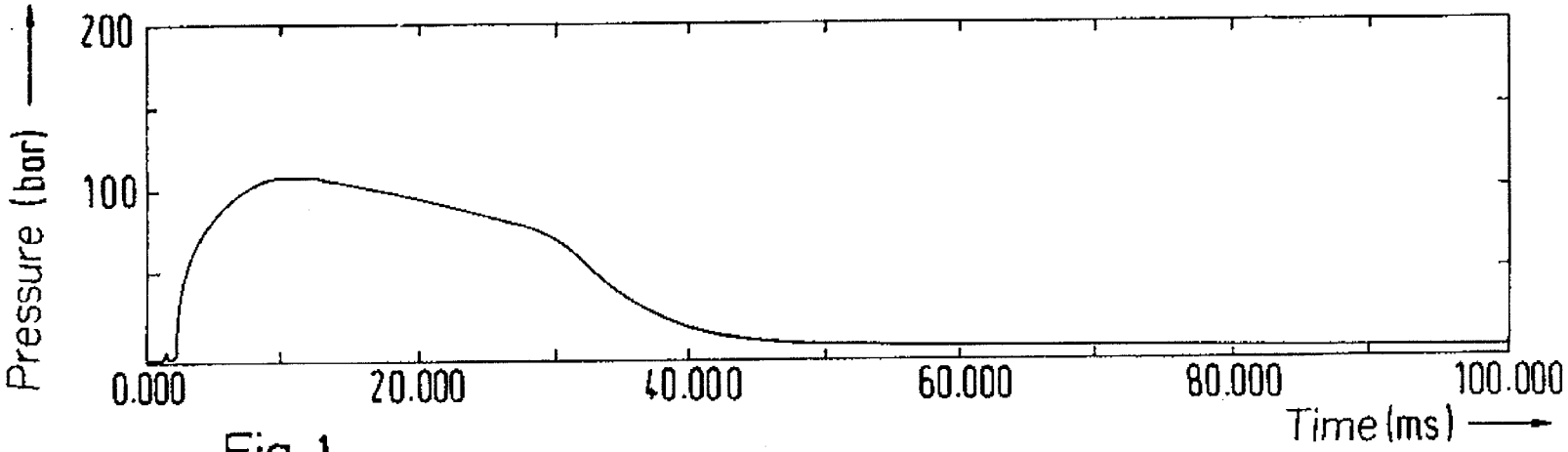
FIG. 1 is a diagram showing the relationship of pressure over time using the mixture according to the invention.

The ignitability of the pellets is further documented by the combustion chamber pressure curve (at 20° C.), which is represented in the diagram in FIG. 1. As is apparent from this diagram, the mixture passes over to stable burnoff immediately after ignition.

EXAMPLE 2

The following powdered substances are mixed together:

62.0 wt. % $NaN_3$ 27.5 wt. % $Fe_2O_3$ 4.0 wt. % $KNO_3$ 6.0 wt. % $SiO_2$ 0.5 wt. % graphite.

The same $SiO_2$ and the same $Fe_2O_3$ were used as in Example 1. Corresponding to Example 1, the mixture was ground until 50 wt. % of the particles had a particle size of less than 7 microns. The mixture was subsequently pressed into tablets. The tablets thus obtained have the same good ignitability as the tablets according to Example 1. The rate of burn-up is sufficiently high.

COMPARISON EXAMPLE

Pellets of the following composition corresponding to U.S. Pat. No. 4,931,111 are tested:

62.0% $NAN_3$, 27.2% $Fe_2O_3$, 2.0% $KNO_3$, 8.0% bentonite, and 0.5% graphite.

The ignitability of these pellets was found to be extremely poor. There were even several ignition failures.

Figure 2:
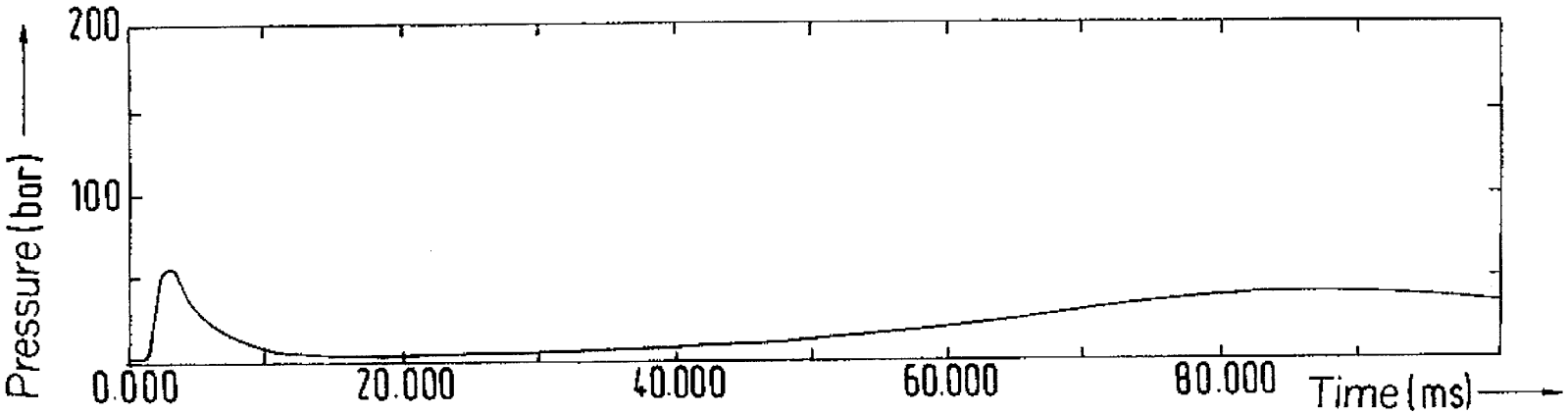
FIG. 2 is a diagram showing pressure over time according the mixture of the prior art.

The poor ignitability of the pellets prepared according to this Comparison Example is further documented by the combustion chamber pressure curve (at 20° C.), which is shown in the diagram in FIG. 2. As is apparent from this diagram, burnoff rapidly drops to 0 after ignition, i.e., an ignition failure nearly develops, and only a very slow increase in pressure can subsequently be observed.

While a specific embodiment of the invention has been shown and described in detail to illustrate the application of the principles of the invention, it will be understood that the invention may be embodied otherwise without departing from such principles.

What is claimed is:

1. Gas-generator mixture for inflating air bags for protecting passengers in motor vehicles, the mixture consisting essentially of:

58–65 wt. % of an alkali or alkaline earth azide,

10–35 wt. % of iron oxide having a specific surface greater than 5 $m^2/g$ and a mean particle size less than 3 microns, and 5–23 wt. % of an accelerator for increasing the rate of burnoff, formed of a metal nitrate and fumed silica, the fumed silica having a specific surface of at least 50 $m^2/g$, wherein the ratio of metal nitrate to the silica ranges from 4:1 to 1:4, the silica content of the mixture is at least 4 wt. %, 50 wt. % of the particles of the mixture have a size of less than 10 microns, and the mixture leads to a minimum output of very fine dust particles at a relatively low combustion temperature, and has a burnoff rate of more than 40 mm/sec as well as satisfactory ignitability.

2. Mixture of claim 1 wherein the metal nitrate is potassium nitrate.

3. Mixture of claim 1 wherein the metal nitrate is sodium nitrate.

4. Gas-generator mixture for inflating air bags for protecting passengers in motor vehicles, the mixture consisting essentially of:

58–65 wt. % of an alkali or alkaline earth azide,

20–30 wt. % of iron oxide having a specific surface greater than 8 $m^2/g$ and a mean particle size less than 1 micron, and 5–19 wt. % of an accelerator for increasing the rate of burnoff, formed of a metal nitrate and fumed silica, the fumed silica having a specific surface of at least 200 $m^2/g$, wherein the ratio of metal nitrate to the silica ranges from 4:1 to 1:4, the silica content of the mixture is at least 4 wt. %, 50 wt. % of the particles of the mixture have a size of less than 10 microns, and the mixture leads to a minimum output of very fine dust particles at a relatively low combustion temperature, and has a burnoff rate of more than 40 mm/sec as well as satisfactory ignitability.

5. Mixture of claim 4 wherein the metal nitrate is potassium nitrate.

6. Mixture of claim 4 wherein the metal nitrate is sodium nitrate.

* * * * *